US008216759B2

(12) United States Patent
Mitamura

(10) Patent No.: US 8,216,759 B2
(45) Date of Patent: Jul. 10, 2012

(54) ELECTROPHOTOGRAPHIC CARRIER AND USE THEREOF

(75) Inventor: Keigo Mitamura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 397 days.

(21) Appl. No.: 12/489,807

(22) Filed: Jun. 23, 2009

(65) Prior Publication Data

US 2009/0324300 A1 Dec. 31, 2009

(30) Foreign Application Priority Data

Jun. 26, 2008 (JP) ..... 2008-167402

(51) Int. Cl.
*G03G 9/00* (2006.01)

(52) U.S. Cl. ..... 430/111.32; 430/58.65; 430/59.4; 430/111.35

(58) Field of Classification Search ..... 430/111.32, 430/58.65, 59.4, 111.35
See application file for complete search history.

(56) References Cited

FOREIGN PATENT DOCUMENTS

| | | |
|---|---|---|
| JP | 2-309365 | 12/1990 |
| JP | 3-73967 | 3/1991 |
| JP | 3-217858 A | 9/1991 |

*Primary Examiner* — Thorl Chea
(74) *Attorney, Agent, or Firm* — Nixon & Vanderhye P.C.

(57) ABSTRACT

The present invention provides an electrophotographic carrier which includes a core particle, a first resin layer containing a charge-generating material for coating the core particle, and a second resin layer containing a hole-transporting material for coating the first resin layer. The invention also provides a two-component developer comprising said carrier, and an image-forming process and apparatus using said developer. According to the invention, high quality images can be formed, with excellent image density (especially when developing solid images) and less fogging.

6 Claims, 2 Drawing Sheets

ELECTROPHOTOGRAPHIC CARRIER AND USE THEREOF

CROSS-REFERENCE TO RELATED APPLICATION

This application is related to Japanese Patent Application No. 2008-167402 filed on Jun. 26, 2008, whose priority is claimed under 35 USC §119, the disclosure of which is incorporated herein in its entirety by reference for any and all purposes.

BACKGROUND OF THE INVENTION

1. Field of the Invention

The present invention relates to an electrophotographic carrier, a two-component developer comprising the carrier, and an electrophotographic image-forming process and apparatus using said developer. In particular, the invention relates to an electrophotographic carrier comprising a core particle and resin layers for coating the core particle, a two-component developer comprising the carrier, and an image-forming process and apparatus, such as copiers, printers, facsimile machines and the like, using said developer.

2. Description of the Related Art

In electrophotographic image-forming apparatuses, generally, an image is formed by the steps of charging, light-exposing, developing, transferring, cleaning, discharging and fixing. More specifically, for example, the surface of a rotating photoconductor drum is uniformly charged by a charger device, and then exposed to laser light emitted from a light-exposure device according to the image information, thereby forming an electrostatic latent image on the surface of the photoconductor drum. The latent mage is developed by a developing device into a toner image, which is then transferred by a transfer device onto a recording material, where the toner image is heated to be fixed by a fixing device. The residual toner on the surface of the photoconductor drum is removed off and collected in a collection chamber by a cleaning device. The cleaned surface of the photoconductor drum is discharged by a discharger device so as to be ready for the next round of the image-forming process.

For developing electrostatic latent images, generally single-component developers comprising toner alone, or two-component developers comprising toner and carriers are used.

Since single-component developers do not need to be stirred before use, they have an advantage that developing devices used therefor have a simple structure with no mixer or the like. However, they have a problem of being difficult to charge toner stably, etc.

On the other hand, since two-component developers need to be stirred before use in order to homogeneously mix toner and carrier, they have a problem that developing devices used therefor have a complicated structure with a mixer or the like. However, two-component developers have good charge stability and good applicability to high-speed machines, and therefore are commonly used in high-speed image-forming apparatuses and multicolor image-forming apparatuses.

As carriers used in two-component developers, magnetic particles of ferrite or the like having a particle size of 20 to 100 μm are generally used. It is known that magnetic particles are coated with acrylic resin, silicone resin or the like (referred to as "coated carriers"), in order to reduce the moisture-dependent changes of the characteristics and adhesion of a toner component onto the surfaces.

However, such coated carriers have high electrical resistance and therefore electric charge opposite in polarity to toner (i.e., counter-charge) tends to remain on their surfaces. Thus, they have a problem that, when used for developing solid images, the image density can be decreased.

In order to resolve this problem, Japanese Laid-Open Patent Publication No. Hei 2-309365 (1990) has proposed a coated carrier whose coating layer contains a photoconductive material. Since light-exposure to the coated carrier causes a decrease in the electrical resistance of the coating layer (carrier resistance), and thus a reduction in the counter-charge remaining on the surface, the coated carrier prevents from decreasing the image density when used for developing solid images.

However, such a coated carrier has a problem that the decreased carrier resistance makes it easier for electric charge to transfer from the photoconductor drum surface to the carrier so as to erase the latent image on the drum surface, and/or for the carrier to travel onto the drum surface so as to cause blurring or fogging in the formed images.

SUMMARY OF THE INVENTION

An objective of the present invention is to provide such an electrophotographic carrier that allows formation of high quality images with excellent image density (especially when used for developing solid images) and less fogging.

Another objective is to provide an image-forming process using said carrier and an image-forming apparatus using said carrier.

Accordingly, the present invention provides an electrophotographic carrier comprising a core particle, a first resin layer containing a charge-generating material for coating said core particle, and a second resin layer containing a hole-transporting material for coating said first resin layer.

The invention also provides a two-component electrophotographic developer comprising said carrier and negatively chargeable toner.

The invention also provides an electrophotographic image-forming apparatus comprising a photoconductor drum, a charger device for charging said photoconductor, a first light-exposure device for forming an electrostatic latent image on said photoconductor, a developing device for storing said two-component developer and developing said latent image into a toner image with the toner of said developer, and a second light-exposure device for light-exposing said developer.

The invention further provides an electrophotographic image-forming process wherein said two-component developer is used as a developer, and is light-exposed before the toner of said developer is supplied to the latent image on the photoconductor drum.

BRIEF DESCRIPTION OF THE DRAWINGS

The present invention will become more fully understood from the detailed description provided herein below and the accompanying drawings which are given by way of illustration only, and wherein.

DETAILED DESCRIPTION OF THE INVENTION

Before the present invention is described in detail, it must be noted that, as used herein and in the appended claims, the singular forms "a", "an" and "the" include plural referents unless the context clearly dictates otherwise.

Electrophotographic Carrier

The electrophotographic carrier of the invention is a coated carrier which comprises: a core particle; a first resin layer containing a charge-generating material for coating said core particle; and a second resin layer containing a hole-transporting material for coating said first resin layer.

On the surface of the carrier of the invention, the counter-charge (positive charge) easily diffuses, since the second resin layer as the outer layer has high hole-mobility due to the hole-transporting material contained therein. On exposing the carrier with light, the holes in the second resin layer are neutralized by the electrons generated by the charge-generating material contained in the first resin layer.

Thus, the carrier of the invention is prevented from accumulating the counter-charge on the surface. As the result, said carrier can prevent from decreasing the image density especially when used for developing solid images.

In addition, since the second resin layer has low electron mobility, the electrons on the photoconductor drum surface are prevented from transferring to the carrier. Thus, the carrier of the invention can be prevented from traveling onto the photoconductor drum. As the result, said carrier allows for the formation of high quality images with less fogging.

In an embodiment, said charge-generating material is a phthalocyanine compound. According to this embodiment, the carrier is provided with more excellent photosensitivity and/or repeat usage characteristics.

In another embodiment, said hole-transporting material is a triphenylamine derivative. According to the present embodiment, the carrier is provided with is further more excellent photosensitivity and/or repeat usage properties, and more excellent charge stability under high humidity conditions.

In another embodiment, a thermoset silicone resin is used, in said first and second resin layers. According to this embodiment, the carrier is provided with more excellent anti-contamination and/or abrasion resistance.

In still another embodiment, said first resin layer is applied and hardened, and subsequently said second resin layer is applied and hardened. According to this embodiment, the carrier is provided with the first and second layers being not or little mixed. The carrier is also still further excellent in photosensitivity and/or repeat usage characteristics, and charge stability under high humidity conditions.

Hereinafter, the present invention will be described in detail.

Figure 1:
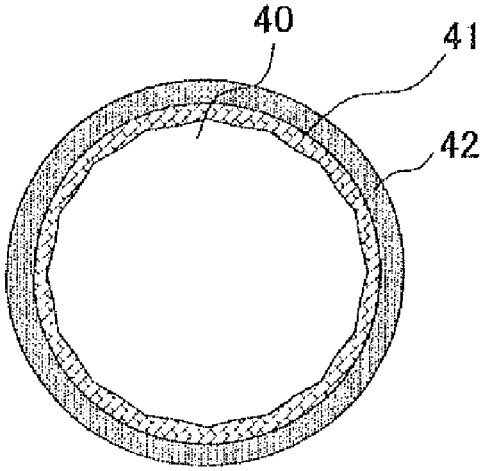
FIG. 1 is a conceptual Illustration of a carrier of the invention.

FIG. 1 is a conceptual diagram illustrating the coating of the core particle with the (first and second) resin layers in a carrier of the invention. The surface (usually rough surface) of a core particle 40 is coated with a first resin layer 41 comprising a charge-generating material, and then with a second resin layer 42 comprising a hole-transporting material.

Core Particle

As the core particles, any magnetic particles can be used. It is preferred to use magnetic particles comprising ferrite (ferrite particles). Since ferrite particles have high saturation magnetization, they can be used to make low density carriers, which do not easily travel onto the photoconductor drum and can form a soft magnetic brush, thereby making images with high dot reproducibility.

For such ferrite particles, any ferrites can be used, such as zinc ferrite, nickel ferrite, copper ferrite, nickel-zinc ferrite, manganese-magnesium ferrite, copper-magnesium ferrite, manganese-zinc ferrite, manganese-copper-zinc ferrite and the like.

The volume average particle size of the core particles preferably ranges from 20 to 100 μm, and more preferably from 30 to 60 μm. The definition of volume average particle size of the core particles is indicated below.

It is preferred that the core particles have a volume resistivity of $1\times10^{6}$ to $1\times10^{11}$ Ω·cm when measured according to the bridge method. Ferrite particles having such a range of volume resistivity are commonly used for core particles of coated carriers since the cost is low. If the volume resistivity is too low, the electrical insulation is insufficient so that toner fogging occurs in the developed images. If the volume resistivity is too high, it is likely that the counter-charge remaining on the carriers causes the edge effect and a decrease in image density of solid images. More preferably, the volume resistivity is in the range of $1\times10^{8}$ to $5\times10^{10}$ Ω·m. The definition of volume resistivity is indicated below.

The ferrite particles can be prepared by any of the known methods. For example, they can be prepared as follows: ferrite materials such as $Fe_2O_3$ or $Mg(OH)_2$ are mixed and calcinated in a furnace. After cooling, the calcination product is milled in a vibrating mill so as to obtain particles having a diameter of about 1 μm. The particles together with a dispersant are added in a water to prepare slurry. The slurry is milled in a wet type ball mill and the resultant suspension is dry-granulated with a spray-drier.

First Resin Layer

The first resin layer is a resin layer for coating the core particle, which contains a charge-generating material. The first resin layer may further contains a hole-transporting material, although it is preferable if it does not since the quantum efficiency is higher.

The thickness of the first resin layer is not limited specifically. For example, it ranges from 0.1 μm to 10 μm, and preferably from 1 μm to 5 μm.

Charge-Generating Material

As the charge-generating material, any of inorganic or organic, photoconductive compounds can be used which are capable of absorbing light to generate free electric charges.

Examples of the inorganic photoconductive compounds include, but are not limited to, inorganic pigments such as selenium and its alloys, arsenic-selenium, cadmium sulfide, zinc oxide, amorphous silicon, and the like.

Examples of the organic photoconductive compounds include, but are not limited to, various organic pigments and dyes such as: azo pigments including monoazo, bisazo and trisazo pigments; indigoid pigments including indigo and thioindigo; perylene pigments including perylene imide and perylenic anhydride; poly cyclic quinone pigments including anthraquinone and pyrenequinone; phthalocyanine pigments including metal phthalocyanines and metal-free phthalocyanines; triphenylmethane dyes including methyl violet, crystal violet, night blue and Victoria blue; acridine dyes including erythrosine, rhodamine B, rhodamine 3R, acridine orange and flapeosine; thiazine dyes including methylene blue and methylene green; oxazine dyes including capri blue and meldola blue; squarylium dyes; pyrylium; thiopyrylium salts; thioindigo dyes; bisbenzoimidazole dyes; quinacridone dyes;

quinoline dyes; lake pigments; azolake pigments; dioxazine dyes; azulenium dyes; triarylmethane dyes; xanthene dye; cyanine dyes; and the like.

One or more charge-generating materials are used in the first resin layer.

It is preferred to use, as the charge-generating material, an organic photoconductive compound, and more preferably a phthalocyanine compound, since they are excellent in sensitivity and repetitive characteristics. Still more preferred are metal-free phthalocyanine compounds, copper phthalocyanine compounds, and titanyl phthalocyanine compounds.

In the first resin layer, the composition ratio (A:B) by weight of the charge-generating material (A) to the resin (B) (described below) ranges from 1:8 to 2:1, for example. The ratio A:B of 1:3 to 1:1 is preferable in view of abrasion resistance and photosensitivity. If the ratio is more than 2:1 (i.e., the charge-generating material is more, and the resin is less), the layer is likely good in photosensitivity but is easy to be released due to decrease in mechanical strength. If the ratio is less than 1:8 (i.e., the charge-generating material is less, and the resin is more), the layer is likely poor in photosensitivity and thus the counter-charge generated by mixing with toner cannot sufficiently be neutralized by light-exposure.

Sensitizer

The first resin layer may further contain a chemical sensitizer and/or a photo sensitizer. The use of such a sensitizer can improve in quantum efficiency of the layer An appropriate chemical sensitizer/photosensitizer for combining with the charge-generating material used can be selected among those known in the art.

Examples of the chemical sensitizers include, but are not limited to, electron acceptor materials including: for example, cyano compounds such as tetracyanoethylene and 7,7,8,8-tetracyanoquinodimethane; quinones such as anthraquinone and p-benzoquinone; nitro compounds such as 2,4,7-trinitrofluorenone and 2,4,5,7-tetranitrofluorenone, and the like.

Examples of the photosensitizers include, but are not limited to, xanthene dyes, thiazine dyes, triphenylmethane dyes, and the like.

Preferably, the sensitizer is used in an amount of 0.1 to 2 parts by weight, and more preferably 0.5 to 1 part by weight, with respect to 100 parts by weight of the charge-generating material.

Resin

The resin used for the first resin layer is not limited. It can be, for example, silicone resin, acrylic resin, or fluorocarbon resin. Thermosetting silicone resin is preferred since the cured product exhibits good contamination resistance and/or abrasion resistance.

Examples of the thermosetting silicone resins include, for example, silicone varnish, such as TSR 115, TSR 114, TSR 102, TSR 103, YR 3061, TSR 110, TSR 116, TSR 117, TSR 108, TSR 109, TSR 180, TSR 181, TSR 187, TSR 144 and TSR 165 (available from Toshiba Corporation, Japan); KR 271, KR 272, KR 275, KR 280, KR 282, KR 267, KR 269, KR 211 and KR 212 (available from Shin-Etsu Chemical Co., Ltd., Japan); alkyd-silicone varnish, such as TSR 184 and TSR 185; epoxy-silicone varnish, such as TSR 194 and YS 54; polyester-silicone varnish such as TSR 187; acrylic-silicone varnish, such as TSR 170 and TSR 171; urethane-silicone varnish, such as TSR 175 (available from Toshiba Corporation, Japan); and reactive silicone resin, such as KA1008, KBE1003, KBC1003, KBM303, KBM403, KBM503, KBM602 and KBM603 (available from Shin-Etsu Chemical Co., Ltd., Japan).

Especially, it is preferable that the carrier has a layer of straight silicone resin (an alkyl substituted silicone resin) since a toner component (binder resin) does not easily adhere onto the layer (i.e., the surface of the carrier), and thus the chargeability of toner used with the carrier is maintained for a long time of period.

Thermosetting silicone resin is silicone resin capable of hardening by forming the Si—O—Si bridge through thermal dehydration reaction or cold setting reaction, as shown below.

Thermal Dehydration

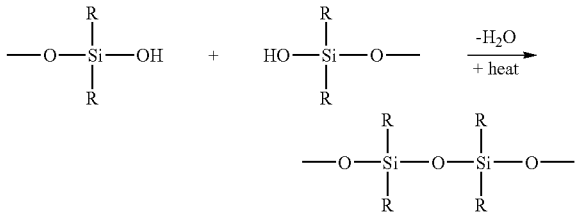

Cold Setting

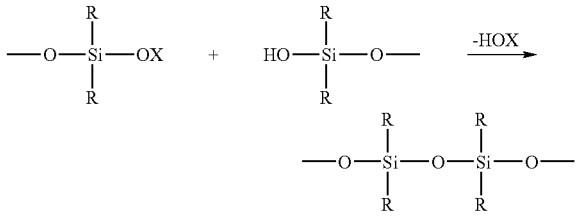

wherein R's, equal to or different from one another, represent monovalent organic groups; the —OX group is acetoxy, aminoxy, alkoxy, or oxime group, or the like.

For hardening, thermosetting silicone resin can be heated to about 200 to 250° C.

Dimethyl silicone is preferred where the monovalent organic groups represented by R are methyl groups, since the cross-linked product has a dense structure, and therefore the coated carrier can be provided with good durability and/or moisture-resistance. However, it should be noted that there is a tendency that a coating layer of cross-linked resin is brittle if the cross-linked structure is too dense, and therefore it is important to select appropriately the molecular weight of the silicone resin used.

It is preferred that the thermosetting silicone resin has a ratio by weight of silicon to carbon (Si/C) of from 0.3 to 2.2. If the ratio Si/C is less than 0.3, it is likely that the hardness of the coating layer is low and therefore the life of the carrier is short. If the Si/C ratio is greater than 2.2, it is likely that the ability of the carrier to impart electric charge to toner is susceptible to changes in temperature, and the coating layer is brittle.

Second Resin Layer

The second resin layer is a resin layer for coating the first resin layer, which contains a hole-transporting material. It is preferable that the second resin layer does not contain a charge-generating material.

The thickness of the second resin layer is not limited. It can range for example from 0.1 μm to 10 μm, and preferably from 1 μm to 5 μm.

Hole-Transporting Material

Examples of the hole-transporting materials include, but are not limited to, carbazole derivatives, pyrene derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylenediamine derivatives, stilbene derivatives, enamine derivatives and benzidine derivatives, as well as polymers having groups derived from the aforesaid compounds or derivatives in the main chain or a side chain-branch, such as poly-N-vinylcarbazole, poly-1-vinylpyrene, ethylcarbazole-formaldehyde resin, triphenylmethane polymer, and poly-9-vinylanthracene, and polysilanes.

More specific examples are poly-N-vinylcarbazole and its derivatives, poly-γ-carbazolyl ethylglutamate and its derivatives, pyrene-formaldehyde condensate and its derivatives, polyvinyl pyrene, polyvinyl phenanthrene, oxazole derivatives, oxadiazole derivatives, imidazole derivatives, 9-(p-diethylaminostyryl)anthracene, 1,1-bis(4-dibenzylaminophenyl)propane, styrylanthracene, styrylpyrazoline, pyrazoline derivatives, phenyl hydrazones, hydrazone derivatives, triphenylamine compounds, tetraphenyldiamine compounds, triphenylmethane compounds, stilbene compounds, and azine compounds having 3-methyl-2-benzo thiazoline ring.

Among them, triphenylamine compounds are preferred since they have good sensitivity, good repetitive characteristics and stable chargeability under high humidity conditions. Specific examples of triphenylamine compounds are:

(1)

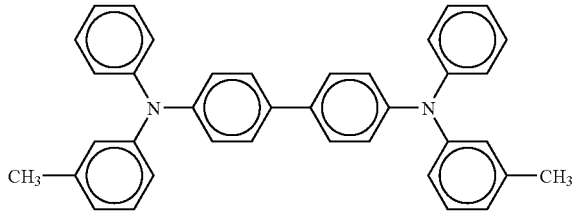

(2)

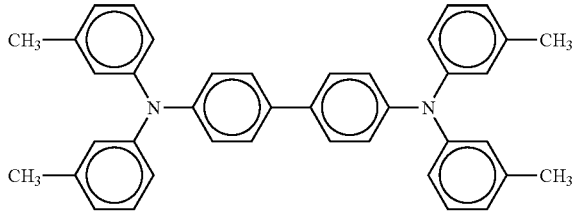

(3)

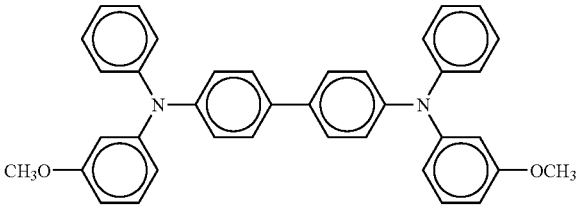

-continued (4)

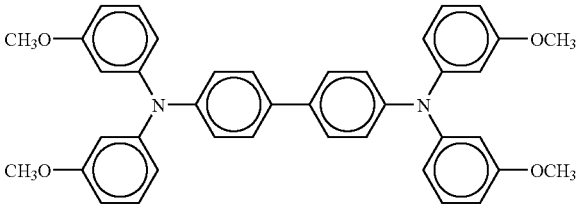

(5)

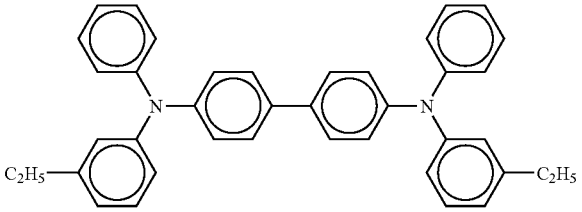

(6)

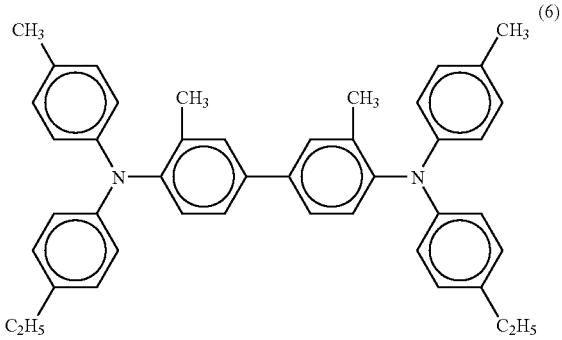

In the second resin layer, the composition ratio (D:E) by weight of the hole-transporting material (D) to the resin (E) (see below) ranges from 1:8 to 2:1, for example. The ratio D:E of 1:4 to 1:1 is preferable in view of abrasion resistance and photosensitivity. If the ratio D:E is more than 2:1 (i.e., the hole-transporting material is more, and the resin is less), the layer is likely good in photosensitivity but is easy to be released due to decrease in mechanical strength. If the ratio is less than 1:8 (i.e., the hole-transporting material is less, and the resin is more), the layer is likely poor in photosensitivity and thus the counter-charge generated by mixing with toner cannot sufficiently be erased by light-exposure.

The resin used for the second resin layer is not limited. It can be any of those described above for the resin used in the first resin layer. The resin in the second resin layer may be the same as or different from the resin in the first resin layer. It is preferred that both are thermosetting silicone resin.

Charge-Improving Agent

The second resin layer may contain a charge-improving agent.

As the charge-improving agent, any of the charge-improving agents known in the art can be used.

The charge-improving agent can be present in an amount of preferably from 1% to 15% by weight, and more preferably from 2% to 10% by weight, of the resin. If the amount is too high, it is likely that the charge-improving agent is difficult to be dispersed evenly in the layer, and that the layer strength decreases.

Method for Forming the Resin Layers

The resin layers can be formed by any of the known methods for forming coating resin layers. For example, the layers are each formed as follows: preparing a coating liquid by solving or dispersing the materials in a suitable solvent;

applying a layer of the coating liquid onto the core particle; and drying and hardening the layer.

The solvent is not limited so far as it can be a solvent in which the resin used (e.g., silicone resin) is solved. Examples of the solvents that can be used for the coating liquid include, but are not limited to, organic solvents such as aromatic hydrocarbons including toluene and xylene; ketones including acetone and methyl ethyl ketone; ethers including tetrahydrofuran and dioxane; higher alcohols; and the like. A single solvent may be used alone, or a mixture of two or more solvents may be used.

In the coating liquid, the resin may be present in an amount of for example from 30 to 200 parts by weight, and preferably from 50 to 150 parts by weight, with respect to 1000 parts by weight of the coating liquid, although the amount can be determined appropriately in view of the working efficiency of application step. If the amount of resin is too small, it takes a long time to form the coating resin layers on the surface of core particles. If it is too large, it is likely that the resin and the charge-improving agent are difficult to be dispersed in the liquid.

The application methods that can be used in the invention include, but are not limited to, the dip coating method wherein the core particles are dipped in the coating liquid, the spraying method wherein the coating liquid is sprayed onto the core particles, the fluid bed method wherein the coating liquid is sprayed onto the core particles floating in a fluid air flow, the kneader coater method wherein the core particles and the coating liquid are mixed in a kneader coater, and then the solvent is removed. Out of them, preferred is the dip coating method since the coating layers are the easiest formed by the method.

For drying the coating layers, a drying agent may be used. As the drying agent, any of the known drying agents can be used. Examples of the drying agents include, but are not limited to, metallic soaps such as metal salts (lead, ferrous, cobalt, manganese, zinc and other salts) of naphthenic acid, octoic acid and the like; organic amines such as ethanolamine; and the like. A single drying agent may be used alone, or a mixture of two or more drying agents may be used.

If the coating layers are hardened by heating, they can be also dried by heating.

The procedure for hardening the coating layer can be selected appropriately according to the kind of the resin used. If thermosetting resin is used, the hardening is carried out by heating to a temperature of, for example, about 200 to 250° C., depending on the kind of the resin. If cold setting resin is used, the hardening may be carried out by heating to a temperature of for example about 150 to 280° C. in order to improve the mechanical, strength of the hardened resin layer and to shorten the time required for hardening, although it is not necessary to do so.

The resin layers may be formed by applying a (first) layer of the coating liquid for the first resin layer onto the core particle, drying if desired, and then applying a (second) layer of the coating liquid for the second resin layer onto the first coating layer, drying if desired, and subsequently hardening the (first and second) layers at the same time.

The resin layers may be also formed by applying a (first) layer of the coating liquid for the first resin layer onto the core particle, followed by drying if desired and hardening, and then applying a (second) layer of the coating liquid for the second resin layer onto the first coating layer, followed by drying if desired and hardening.

It is preferred if the first resin layer is applied and hardened, and subsequently the second resin layer is applied and hardened, since thus-obtained layers are not or little mixed and therefore can be separated functionally from each other.

Other Features of the Carrier

The volume average particle size of the carriers is preferably from 20 to 100 μm, and more preferably from 30 to 60 μm, although it is not limited. If the carriers have too small a volume average particle size, it is likely that they travel easily from the developing roller to the photoconductor drum during the developing step, and thus that white spots appear in the toner image. If the carriers have too large a volume average particle size, it is likely that the developer comprising the carriers is poor in dot reproducibility and the toner image is rough. In the context of the volume average particle size of the carriers, the particle size is intended to mean the sum of the diameter of the core particle and the thickness of the first and second resin layers coated on or over the core particle. The definition of volume average particle size is indicated below.

The lower the saturation magnetization of the carriers is, the softer the magnetic brush is and therefore the more faithful to the latent image the toner image is. However, if the saturation magnetization is too low, it is likely that the carriers are easy to travel to the photoconductor drum, and therefore white spots appear in the toner image. On the other hand, if the saturation magnetization is too high, it is likely that the magnetic brush is too hard to form the toner image faithful to the latent image. Accordingly, the saturation magnetization of the carriers is preferably in the range of from 30 to 100 emu/g, and more preferably from 50 to 80 emu/g. The definition of saturation magnetization of the carriers is indicated below.

If the volume resistivity of the coated carriers is too low, it is likely that the carriers are easy to travel to the photoconductor drum. If the volume resistivity is too high, it is likely that the carriers cause a large increase in the toner charge. Accordingly, the volume resistivity of the carriers is preferably in the range of from $1\times10^{8}$ to $5\times10^{12}$ Ω·cm, and more preferably from $1\times10^{9}$ to $5\times10^{12}$ Ω·cm. The definition of volume resistivity is indicated below.

Two-Component Developer

The developer of the present invention is a two-component developer comprising a negatively chargeable toner and the carrier as described above. The developer of the invention allows formation of high quality toner images with less decrease in the image density and less toner fogging.

The mixing ratio is generally from 3 to 15 parts by weight of the toner with respect to 100 parts by weight of the carriers. The methods for mixing the toner and the carriers include mixing in a mixer such as a Nauta mixer.

Toner

The toner is not limited so far as it is negatively chargeable toner. Any negatively chargeable toner can be used, including, for example, toner described below.

The toner comprises a colored resin particle (toner particle) and optionally an external additive attached to the surface of the particle. It is preferred that the toner comprises an external additive since it prevents the toner particles from aggregating, and thus from decreasing in the transfer efficiency from the photoconductor drum to the recording material.

The volume average particle size of the colored resin particles is preferably in the range of from 4 to 7 μm. The use of the colored resin particles within such a size range can provide high quality images with good dot reproducibility and with less toner fogging or scattering. The definition of volume average particle size of the colored resin particles is indicated below.

The BET specific surface area of the colored resin particles is preferably from 1.5 to 1.9 $m^2/g$. When the BET specific surface area is 1.9 $m^2/g$ or less, the surfaces of the colored resin particles do not have many depressed portions which are capable of catching the external additive, and therefore it is easy to distribute the external additive nearly evenly on the surface. As the result, the external additive can more efficiently exert the roller effect (for improving the toner fluidity) and spacer effect (for preventing the electric charge leakage), and toner fogging and scattering occur even less frequently in the toner image. When the BET specific surface area is 1.5 $m^2/g$ or greater, the surface of the colored resin particle is not too smooth to be removed by cleaning devices, and therefore it is less likely that the surface of the photoconductor drum is insufficiently cleaned during the cleaning step. As the result, toner fogging occurs less frequently in the toner image.

The BET specific surface area can be varied by any known methods, including, for example, a method wherein the colored resin particles are rounded in a rotating drum, and a method using a surfusion system wherein the colored resin particles are rounded by being melted instantaneously in a heated air flow. The definition of BET specific surface area is indicated below.

The colored resin particles can be prepared by any known methods such as mill pulverization and polymerization. For example, in the mill pulverization, the colored resin particles are prepared according to the following manner. A binder resin and a colorant, and optionally a charge control agent, a release agent and/or other additives are mixed in a mixer such as Henschel mixer, super mixer, mechanomill, or Q-type mixer. The resulting mixed materials are melt-kneaded at a temperature of 100 to 180° C. in a kneader such as a single screw kneader or a twin screw kneader. The kneaded materials are cooled, solidified, and then pulverized by an air pulverizer such as a jet mill so as to obtain particles. The pulverized particles are optionally subjected to sizing or classifying.

As the binder resin, any of the commonly-used resins can be used, such as styrene-based resin, acrylic resin, polyester resin and the like, although linear or non-linear polyester resin is preferable. Polyester resin can satisfy all the requirements of mechanical strength (sufficient for the toner not easily to break down into finer particulates), fixability (sufficient for the toner not easily to be released from the paper on which it is fixed) and hot offset resistance.

Polyester resin can be obtained by polymerizing a monomer composition comprising a polyhydric alcohol and a polybasic acid.

The dihydric alcohols that can be used for preparing polyester resin include for example diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, and 1,6-hexanediol, bisphenol A, hydrogenated bisphenol A, bisphenol A alkylene oxide adduct such as polyoxyethylene bisphenol A and polyoxypropylene bisphenol A, and the like.

The dibasic acids that can be used for preparing polyester resin include for example maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, anhydrides and lower alkylester thereof, and alkenyl succinates or alkyl succinates such as n-dodecenyl succinate and n-dodecyl succinate.

As appropriate, a trihydric or higher polyhydric alcohol and/or a tribasic or higher polybasic acid may be added in the monomer composition. The trihydric or higher polyhydric alcohols that can be used for preparing polyester resin include for example sorbitol, 1,2,3,6-hexane tetrol, 1,4-sorbitan, pentaerythritol, dipentacrythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and the like.

The tribasic or higher polybasic acids that can be used for preparing polyester resin include for example 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxyiic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid and anhydrides thereof, and the like.

As the colorant, any of the commonly-used pigments or dyes for toner can be used.

Specifically, the colorants that can be used for black toner include for example carbon black, magnetite, and the like.

The colorants that can be used for yellow toner include, for example, acetoacetic acid arylamide type monoazo yellow pigments such as C.I. Pigment Yellow 1, C.I. Pigment Yellow 3, C.I. Pigment Yellow 74, C.I. Pigment Yellow 97, C.I. Pigment Yellow 98; acetoacetic acid arylamide type disazo yellow pigments such as C.I. Pigment Yellow 12, C.I. Pigment Yellow 13, C.I. Pigment Yellow 14, and C.I. Pigment Yellow 17; condensed monoazo yellow pigments such as C.I, Pigment Yellow 93 and C.I. Pigment Yellow 155; other type of yellow pigments such as C.I. Pigment Yellow 180, C.I. Pigment Yellow 150, and C.I. Pigment Yellow 185; yellow dyes such as C.I. Pigment Yellow 19, C.I. Pigment Yellow 77, and C.I. Pigment Yellow 79, C.I. disperse yellow 164; and the like.

The colorants that can be used for magenta toner include, for example, red or magenta pigments such as C.I. Pigment Red 48, C.I. Pigment Red 49:1, C.I. Pigment Red 53:1, C.I. Pigment Red 57, C.I. Pigment Red 57:1, C.I. Pigment Red 81, C.I. Pigment Reel 122, C.I. Pigment Red 5, C.I. Pigment Red 146, C.I. Pigment Red 184, C.I. Pigment Red 238, C.I. Pigment Violet 19; red dyes such as C.I. Solvent Red 49, C.I. Solvent Red 52, C.I. Solvent Reel 58, C.I. Solvent Red 8; and the like.

The colorants that can be used for cyan toner include, for example, blue pigments of copper phthalocyanine and derivatives thereof such as C.I. Pigment Blue 15:3, C.I. Pigment Blue 15:4; green pigments such as C.I. Pigment Green 7, C.I. Pigment Green 36 (Phthalocyanine Green); and the like.

The content of the colorant is preferably from 1 to 15 parts by weight, and more preferably 2 to 10 parts by weight, with respect to 100 parts by weight of the binder resin.

The toner may comprise a charge control agent so as to be chargeable more stably. As the charge control agent, any of the negative and positive control agents used for toner can be used.

Specifically, the negative charge control agents include for example chromium-azo complex dyes, iron-azo complex dyes, cobalt-azo complex dyes, chromium/zinc/aluminium/boron complexes or salts of salicylic acid and derivatives thereof, chromium/zinc/aluminium/boron complexes or salts of naphthoic acid and derivatives thereof, chromium/zinc/aluminium/boron complexes or salts of benzilic acid and derivatives thereof, chromium/zinc/aluminium/boron complexes or salts of long chain alkyl carboxylates, long chain sulfonates, and the like. The expression "chromium/zinc/aluminium/boron complexes or salts" is intended herein to mean chromium complex or chromium salt compounds, zinc complex or zinc salt compounds, aluminium complex or aluminium salt compounds, or boron complex or boron salt compounds.

The positive charge control agents include for example nigrosine dyes and derivatives thereof, triphenyl methane derivatives, quaternary ammonium salts, quaternary phosphonium salts, quaternary pyridinium salts, guanidine salts, amidine salts, and the like.

The content of the charge control agent in the toner is preferably from 0.1 to 20 parts by weight and more preferably 0.5 to 10 parts by weight, with respect to 100 parts by weight of the binder resin.

The toner may comprise a release agent so as to improve the releasability from a fixing roller or belt, and to prevent hot offset and cool offset during the fixing step. As the release agent, any of the commonly-used release agents for toner can be used.

The release agents that can be used for the toner include for example synthetic waxes, such as polypropylene and polyethylene; petroleum waxes and the denatured waxes such as paraffin waxes and derivatives thereof, micro crystalline waxes and derivatives thereof; vegetable waxes such as carnauba wax, rice wax, candelilla wax and derivatives thereof, and the like.

The amount of the release agent added generally ranges from 1 to 5 parts by weights with regard to 100 parts by weight of the binder resin, although it is not limited.

As the external additive, inorganic particulates having a number average particle size of 7 to 100 nm can be used, such as silica, titania, or alumina particulate. The external additive may be such inorganic particulates that are hydrophobized by being treated with a silane-coupling agent, titanium-coupling agent, silicone oil or the like. It is preferred to use the hydrophobic inorganic particulates since they can reduce the decrease in the electrical resistance or charge amount of the toner under high humidity environments. In particular, silica particulates whose surfaces are functionalized with trimethylsilyl groups by using hexamethylsilazane (hereinafter, also referred to as "HMDS") as a silane coupling agent have excellent hydrophobicity and insulation properties. The toner wherein such silica particulates are externally added has excellent chargeability even under high humidity environments.

Specific examples of the external additives include AEROSIL 50, AEROSIL 90, AEROSIL 130, AEROSIL 200, AEROSIL 300 and AEROSIL 380 (number average particle size: about 30, 30, 16, 12, 7, and 7 nm respectively; Nippon Aerosil Co., Ltd., Japan) for silica; Aluminum Oxide C (number average particle size: about 13 nm; Degussa AG, Germany) for alumina; Titanium Oxide P-25 (number average particle size: about 21 nm; Degussa AG, Germany), and TTO-51 and TTO-55 (number average particle size: about 20 and 40 nm, respectively; Isihara Sangyo Kaisha Ltd., Japan) for titania; MOX 170 (number average particle size: about 16 nm; Nippon Aerosil Co., Ltd., Japan) for mixed silica and alumina, and the like. The Definition of number average particle size of the external additives is indicated below.

The amount of the external additive added is preferably from 0.2 to 3% by weight. The external additive added in such an amount can provide a sufficient fluidity to the toner while not decreasing the fixability.

The external additive is externally added to the colored resin particle by mixing them in an air flow mixer such as a Henschel mixer.

Image-Forming Process

It should be noted that the image-forming process of the present invention is not limited and may be any type of electrophotographic process, wherein the two-component developer of the invention is used as a developer and exposed with light before the toner is supplied to a latent image.

By the image-forming process of the invention, high quality images can be obtained with less decrease in the image density, less toner fogging, and/or less carrier traveling.

For example, the image-forming process may be a process for forming monochrome or multicolor images, which comprises the following steps of: charging evenly the surface of a photoconductor drum; light-exposing said charged surface of said photoconductor drum according to the image information so as to form an electrostatic latent image corresponding to said image information thereon; light-exposing the two-component developer of the invention that has been frictionally charged; and developing said latent image with the toner of said two-component developer that has been light-exposed.

It is preferred to light-expose the developer that has been formed into a thin magnetic brush.

The image-forming process may further comprise the steps of transferring the developed image (or toner image) on a recording material; fixing the transferred toner image on said recording material; removing and collecting the toner remaining on said surface of said photoconductor drum; and removing the residual electrostatic charge on said surface.

The image-forming process may be carried out with, for example, the image-forming apparatus described below.

Image-Forming Apparatus

It should be noted that the image-forming apparatus of the present invention can be provided in any type of configuration and/or arrangements for electrophotographic image-forming apparatuses using two-component developers, so far as it uses the developer of the invention as a two-component developer, and comprises a light exposure device for light-exposing the developer after being frictionally charged, but before the toner of the developer is supplied to a latent image.

By the image-forming apparatus of the invention, high quality images can be obtained with less decrease in the image density, less toner fogging, and/or less carrier traveling.

In an embodiment, the image-forming apparatus comprises: a photoconductor drum, on the surface of which an electrostatic latent image is to be formed; a charger device, which charges said surface of said photoconductor drum; a (first) light-exposure device, which forms a latent image on said surface; a developing device, which stores the two-component developer of the invention and supplies the toner of said developer to said latent image so as to develop it into a toner image; a (second) light-exposure device for developer, which light-exposes said two-component developer.

The image-forming apparatus may further comprises an image transfer device, which transfers said toner image onto a recording medium; a cleaner device, which cleans said surface; and an image-fixing device, which fixes said toner image onto said recording material.

In a specific embodiment, said developing device comprises a developing roller, which carries said developer and supplies it onto said latent image, and said second light-exposure device light-exposes said developer carried on said developing roller.

In this embodiment, the developer carried on the developing roller is light-exposed after being formed into a thin magnetic brush, thereby ensuring that the carriers of the developer are exposed with light, and therefore the countercharge on the carriers can be erased. As the result, high quality images can be obtained with less decrease in the image density, less toner fogging, and/or less carrier traveling.

The image-forming apparatus can be for example a copier, printer, facsimile machine or a composite machine thereof.

The image-forming apparatuses will be now described specifically with reference to the attached drawings.

Figure 2:
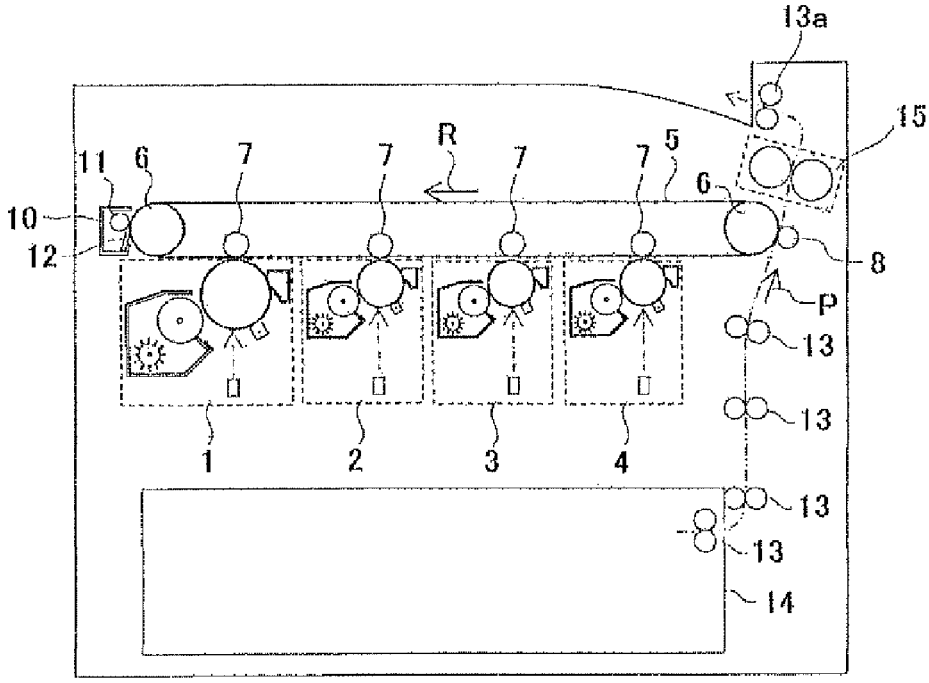
FIG. 2 is a schematic view illustrating an embodiment of an image-forming apparatus of the invention.

FIG. 2 is a schematic illustration showing an embodiment of an image-forming apparatus of the invention. The illustrated image-forming apparatus is a color image-forming apparatus provided with four image-forming units 1-4 in tandem. Reference number 1 represents a first image-forming unit for forming black toner images. Reference number 2 represents a second image-forming unit for forming cyan toner images. Reference number 3 represents a third image-forming unit for forming magenta toner images. Reference number 4 represents a fourth image-forming unit for forming yellow toner images.

Over the four image-forming units 1-4, an intermediating transfer belt (endless belt) 5 is provided. The belt 5 is hanged on two supporting rolls 6, and rotates in the direction indicated by the arrow R. Hereinafter, the terms "upstream" and "downstream" are intended herein to mean the relative positions with respect to the direction of rotation of the belt 5. The material of the belt 5 can be a resin, such as polyimide or polyamide, which contains an appropriate amount of an electronically conductive agent.

The four image-forming units 1-4 are arranged from upstream to downstream in the order of the first (black) image-forming unit 1, the second (cyan) image-forming unit 2, the third (magenta) image-forming unit 3 and the fourth (yellow) image-forming unit 4.

Inside of the loop of the intermediating transfer belt 5, four primary transfer rollers 7 are provided with facing the respective photoconductor drums of the image-forming units 1-4. The four primary transfer rollers 7 transfer the respective monochromatic toner images formed by the image-forming units 1-4 onto the belt 5, where the monochromatic toner images are superimposed into a color image.

Downstream to the fourth (yellow) image-forming unit 4, a secondary transfer roller 8 is provided which transfers the color image formed on the belt 5 onto a paper (recording medium).

Downstream to the secondary transfer roller 8 and upstream to the first image-forming unit 1, a belt cleaning unit 10 is provided which cleans the surface of the intermediating transfer belt 5. The belt cleaning unit 10 comprises a belt cleaning brush 11, which is provided in contact with the belt 5, and a belt cleaning blade 12, which is provided downstream to the belt cleaning brush 11.

Below the image-forming units 1-4, a paper tray 14 is provided which stores papers. The papers are transported one by one by feed rollers 13 from the tray 14 to the secondary transfer point where the secondary transfer roller 8 faces the intermediating transfer belt 5. The arrow P indicates the direction of transportation of the papers.

Downstream to the secondary transfer roller 8 in the direction P, a fixing unit 15 is provided which fixes the transferred color image onto the paper. Further downstream to the fixing unit 15, a paper eject roller 13*a* is provided which ejects the paper, on which the color image is fixed, from the image-forming apparatus.

In the arrangement explained above, the respective monochromatic toner images formed by the image-forming units 1-4 are sequentially transferred onto the intermediating transfer belt 5 and formed into a color image thereon. The color image is secondary-transferred from the belt 5 onto the paper transported by feed rollers 13 at the secondary transfer point. The color image is then fixed onto the paper by the fixing unit 15. The paper, on which the color image is fixed, is ejected from the image-forming apparatus by the paper eject rollers 13*a*. The toner remaining on the belt 5 is removed by the belt cleaning unit 10.

Figure 3:
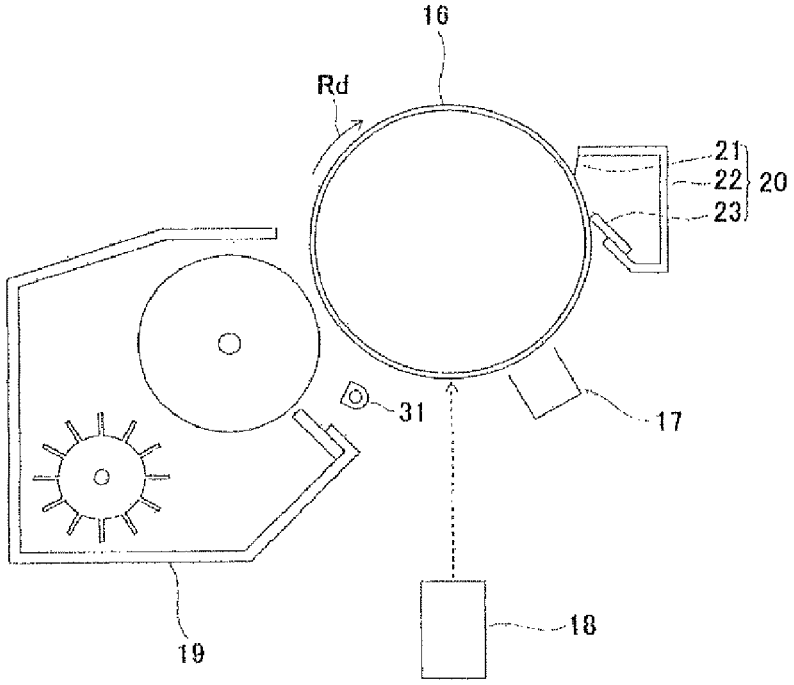
FIG. 3 is a schematic view illustrating an image-forming unit used in an image-forming apparatus of the invention.

FIG. 3 is an enlarged illustration of the first image-forming unit 1 shown in FIG. 2. The structures of the other image-forming units 2-4 are substantially the same as the first image-forming unit 1. Therefore, the detailed description of the second, third and fourth image-forming units are omitted.

Along the circumferential surface of the photoconductor drum 16, arranged are a charger device 17, which charges the drum 16; a first light-exposure device 18, which writes an electrostatic latent image on the drum 16; a developing device 19, which, visualizes the latent image on the drum 16 with the two-component developer of the invention; and a drum cleaner device 20, which remove the residues (including toner) remaining on the drum 16 after primary transferring. In the vicinity of the developing device 19, a second light-exposure device 31 is provided, which light-exposes the developer carried on a developing roller.

The charger device 17 comprises, for example, a scorotron charger, which charges the surface of the photoconductor drum 16 at a given potential by corona charging. The charger device 17 may comprise a corotoron charger or a contact charger using a charger roller or brush.

The first light-exposure device 18 comprises, for example, a laser exposure device, which emits light according to the image information, as scanning the charged surface of the drum 16 so that an electrostatic latent image is formed corresponding to the image information by erasing the electric charge in the light-exposed area of the surface. The first light-exposure unit 18 may comprise an LED array device or the like.

The developing device 19 stores the two-component developer of the present invention in a developer tank, and develops the latent image on the surface of the drum 16 with the toner contained in the developer.

The drum cleaner device 20 comprises a cleaner blade 21, a cleaner housing 22 and a sealer 23.

The cleaner blade 21 is pressed to the surface of the photoconductor drum 16 against the direction of rotation Rd of the drum 16 and scrapes the residues from the surface of the drum 16. The cleaner blade 21 is attached to the cleaner housing 22 in which the scraped residues are collected. The sealer 23 is provided upstream to the cleaner blade 21 in the direction of rotation Rd. One edge of the sealer 23 is fixed to the cleaner housing 22 and the other edge is pressed against the surface of the drum 16 so that the sealer 23, together with the cleaner blade 21, seals the housing 22.

Figure 4:
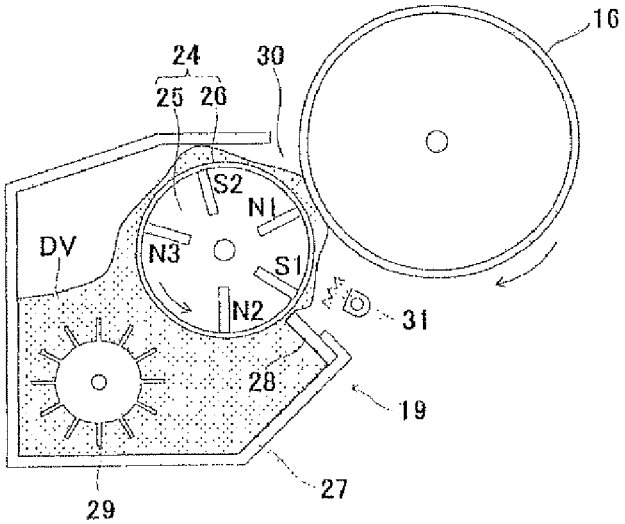
FIG. 4 is an extended schematic view illustrating a developing device used in an image-forming apparatus of the invention.

FIG. 4 illustrates, in more detail, the structure of the developing device 19 shown in FIG. 3.

The developing device 19 comprises a developer tank 27 which stores the two-component developer DV of the invention. The tank 27 has an opening 30 facing the circumferential surface of the photoconductor drum 16.

In the tank 27, a developing roller 24 is provided with facing the drum 16 through the opining 30. The developing roller 24 carries the two-component developer on its circumferential surface and supplies it onto the drum 16 so as to develop the latent image thereon. The circumferential surfaces of the developing roller 24 and the drum 16 are spaced at a given distance.

The developing roller 24 comprises a multipole magnetic member 25 and a non-magnetic sleeve 26 mounted rotatably thereon. The magnetic member 25 comprises for example five rectangular bar magnets in a radial arrangement so that the N poles (N1, N2 and N3) of three magnets and the S poles (S1 and S2) of the remaining magnets are spaced on the circumferential surface of the magnetic member 25 (see FIG. 4).

The multipole magnetic member 25 is nonrotatably supported by two opposite side walls of the tank 27. The N1 pole (peak flux density: 110 mT) is situated on the line connecting the center of the magnetic member 25 and the center of rotation of the photoconductor drum 16. The S1 pole (−78 mT) is situated upstream to the N1 pole in the direction of rotation the sleeve 26, with the center angle between the S1 and N1 poles being 59° for example. The N2 pole (56 mT) is situated more upstream to the N1 pole, with the center angle between the N2 and N1 poles being 117° for example. The N3 pole (42 mT) is situated further more upstream to the N1 pole, with the center angle between the N3 and N1 poles being 224° for example. The S2 pole (−80 mT) is situated still further more upstream to the N1 pole, with the center angle between the S1 and N1 poles being 282° for example.

A metering member 28 is provided upstream from the closest point of the sleeve 26 to the circumferential surface of the photoconductor drum 16, in the direction of rotation of the sleeve. The metering member 28 regulates the thickness of the layer of the developer carried by the sleeve 26, i.e., the amount of the developer to be supplied to the latent image. The metering member 28 is situated at a given distance from the surface of the sleeve 26.

In the tank 27, a mixing member 29 is provided with facing the developing roller 24. The mixing member 29 can rotate so as to mix the developer DV in the tank 27 and supply the developer DV to the developing roller 24.

The second light-exposure device 31 for developer is provided in such a manner that the two-component developer carried on the sleeve 26 is light-exposed downstream from the metering member 28 in the direction of rotation the sleeve, and upstream a developing area (where the two-component developer is contacted with the photoconductor drum 16).

The second light-exposure device 31 may be a light-exposure device of any form, so long as it can emit the light that the charge-generating material, in the carriers of the developer can absorb to generate electric charge. The second light-exposure device 31 can be a light-exposure device that is used as a discharger lamp, such as a halogen lamp, a tungsten lamp, xenon lamp, a fluorescent lamp, a light-emitting diode (LED), and preferably a halogen lamp.

The second light-exposure device is provided in such a manner that it can light-expose the two-component developer to be supplied to the photoconductor drum but it cannot light-expose the surface of the drum. The positioning of the second light-exposure device may be inside or outside the developing device 19. Preferably, the second light-exposure device is positioned in such a manner that it can light-expose the developer just before the developing area.

The second light-exposure device emits light at all times or during the two-component developer is supplied in the developing area so as to ensure that the developer is light-exposed at the predetermined position or area.

DEFINITIONS

The terms "volume average particle size", "saturation magnetization", "volume resistivity", "BET specific surface area" and "number average particle size" used herein are defined below:

Volume Average Particle Size of the Carriers and the Core Particles

The volume average particle size of the carriers or the core particles, as used herein, is intended to mean a value determined by using the Sympatec HELOS laser diffraction spectrometer (Sympatec GmbH, Germany) with the Sympatec RODOS dry disperser (Sympatec GmbH, Germany) under a dispersing pressure of 3.0 bar.

Volume Average Particle Size of the Colored Resin Particles and Toner

The volume average particle size of the colored resin particles and toner, as used herein, is intended to mean a value determined by using the Coulter Multisizer II particle size analyzer (Beckman Coulter Inc., U.S.A.) with an aperture diameter of 100 μm. More specifically, the measuring apparatus is Coulter Counter TA-II or Coulter Multisizer II (Beckman Coulter Inc., U.S.A.). As an electrolyte solution, 1% sodium chloride solution is used, such as ISOTON R-II (Coulter Scientific Japan, Inc., Japan).

For measurement, 2 to 20 mg of sample is added in 100 to 150 ml of the electrolyte solution, to which 0.1 to 5 ml of a surfactant (preferably alkylbenzene sulfonate) has previously been added as a dispersing agent. The resulting suspension is subjected to dispersion treatment with an ultrasonic disperser for 1 to 3 minutes. The volume and the number of the particles in the suspension are measured on the said particle size analyzer with an aperture of 100 μm to create volume and number distributions of the particle size. The volume distribution is used to determine the volume average particle size.

Saturation Magnetization

The saturation magnetization, as used herein, is intended to mean a value determined by using the Vibrating Sample Magnometer VSMP-1 (Toei Industry Co., Ltd., Japan).

Volume Resistivity

The volume resistivity of the core particles, as used herein, is intended to mean a value determined according to the following manner. The core particles of 0.2 g are filled in between two copper electrode plates (30 mm wide×10 mm high) spaced 6.5 mm under environmental conditions of a temperature of 20° C. and a humidity of 65%. Then, two magnets (100 mT each) are placed outside the respective electrode plates with the N pole of one facing the S pole of the other, so that the magnetic force causes the core particles or carriers to bridge the electrode. Fifteen seconds after applying a voltage of 500 V between the electrodes, the electric current therebetween is measured. The electric current is used to determine the volume resistivity.

BET Specific Surface Area

The BET specific surface area, as used herein, is intended to mean a value determined by the three-point method using the surface area analyzer Gemini 2360 (Shimadzu Corporation, Japan)

Number Average Particle Size

The number average particle size, as used herein, is intended to mean the number average diameter of 100 particles in a scanning electron microscopic (SEM) image.

EXAMPLES

The present invention will better understood with reference to the following examples, which are intended only to illustrate the invention, but are not intended to limit the scope of the invention in any way.

Carrier

The carriers used in the following Examples and Comparative Examples were prepared according to the following manner.

Ferrite materials (available from Kanto Denka Kogyo Co., Ltd., Japan) were mixed in a ball mills, and then calcinated at a temperature of 900° C. in a rotary kiln. The calcinated particles were milled in a wet mill (using steel balls as milling medium) so as to give fine particles having an average diameter of 1 μm or less. The resulting powder was granulated with a spray-dryer. The granulates were baited at a temperature of 1300° C., and then crushed so as to obtain ferrite core particles having a volume average particle size of 43 μm and a volume resistivity of $1\times10^{9}$ Ω·m.

For forming the first resin layer, a coating liquid S1 was prepared by solving or dispersing 100 parts by weigh of dimethyl silicone (available from Toshiba Silicone Co., Ltd., Japan) and 50 parts by weight of metal-free phthalocyanine (available from Hodogaya Chemical Co., Ltd., Japan) in 850 parts by weight of toluene. In a dip-coating apparatus, 100 parts by weight of the core particles and 30 parts by weight of the coating liquid S1 were mixed and then the toluene was evaporated so as to prepare primary coated carriers, each of which has the first resin layer.

For forming the second resin layer, a coating liquid S2 was prepared by solving 100 parts by weigh of dimethyl silicone (available from Toshiba Silicone Co., Ltd.), 25 parts by weigh of a triphenylamine represented by the formula (I) (available from Hodogaya Chemical Co., Ltd.) in 850 parts by weigh of toluene. In a dip-coating apparatus, 100 parts by weight of the primary coated carriers and 30 parts by weight of the coating liquid S2 were mixed and then the toluene was evaporated, followed by curing at a temperature of 230° C. for 30 minutes so as to prepare carriers C1, each of which has the first and second resin layers.

Carrier C1 had a volume average particle size of 45 μm, a surface coverage of 100%, and a magnetization saturation of 65 emu/g.

Carriers C2-C8 were prepared as described above for C1 except that the kind of the respective charge-generating materials and/or hole-transporting materials were different from those used for C1, as shown in Table 1.

Carriers C9-C12 were prepared as described above for C1 except that one or both of the charge-generating materials and the hole-transporting materials was/were not added, or one or both of the first and the second resin layers was/were not formed, as shown in Table 1.

TABLE 1

| | Coated Carriers | | | | | |
|---|---|---|---|---|---|---|
| | First Resin Layer Coating Liquid S1 | | Second Resin Layer Coating Liquid S2 | | | |
| | Charge-Generating Material | Amount Added[1)] (parts by weight) | Hole-Transporting Material | Amount Added[2)] (parts by weight) | Volume Average Particle Size (μm) | Saturation Magnetization (emu/g) |
| C1 | Metal-free phthalocyanine | 30 | Formula (1) | 30 | 45 | 65 |
| C2 | Metal-free phthalocyanine | 30 | Formula (2) | 30 | 45 | 65 |
| C3 | Metal-free phthalocyanine | 30 | Formula (3) | 30 | 45 | 65 |
| C4 | Metal-free phthalocyanine | 30 | Formula (4) | 30 | 45 | 65 |
| C5 | Metal-free phthalocyanine | 30 | Formula (5) | 30 | 45 | 65 |
| C6 | Metal-free phthalocyanine | 30 | Formula (6) | 30 | 45 | 65 |
| C7 | Copper phthalocyanine | 30 | Formula (1) | 30 | 45 | 65 |
| C8 | Titanyl phthalocyanine | 30 | Formula (1) | 30 | 45 | 65 |
| C9 | None | 30 | None | 30 | 43 | 65 |
| C10 | Metal-free phthalocyanine | 30 | None | 30 | 44 | 65 |
| C11 | Metal-free phthalocyanine | 30 | — | — | 43 | 65 |
| C12 | — | — | — | — | 44 | 65 |

[1)]with respect to 100 parts by weight of the core particles
[2)]with respect to 100 parts by weight of the primary coated carriers Toner Toners were prepared according to the method described below.

The toner materials used were:

Binder resin (polyester resin obtained by polycondensing bisphenol A propylene oxide with terephthalic acid or trimellitic acid anhydride as monomers, glass transition temperature (Tg)=62° C., softening temperature=110° C.; available from Fujikura Kasei Co., Ltd., Japan): 100 parts by weight Colorant (MA-100, carbon black; available from Mitsubishi Chemical Corporation, Japan): 5 parts by weight Charge control agent (LR-147, a boron, compound; available from Japan Carlit Co., Ltd., Japan): 2 parts by weight Release agent (Microcrystalline Wax HNP-9; available from Nippon Seiro Co., Ltd., Japan): 3 parts by weight After the toner materials were mixed in a Henschel mixer for 10 minutes, they were melt-kneaded at 150° C. in a kneader-pelletizer (KNEADEX MOS140-800; available from Mitsui Mining Co., Ltd., Japan). The kneaded materials were cut into pieces by a cutting mill, and then pulverized by a jet pulverizer (IDS-2; available from Nippon Pneumatic Mfg. Co., Ltd., Japan). The pulverized particles were classified with a air classifier (MP-250; available from Nippon Pneumatic Mfg. Co., Ltd., Japan), so as to obtain colored resin particles having a volume average particle size of 6.5±0.1 μm and a BET specific surface area of 1.8±0.1 $m^2/g$.

One hundred parts by weight of the colored resin particles obtained were mixed with 1 part by weight of hexamethyldisilazane-treated silica particles with a number average particle size of 12 nm (AEROSIL R8200; available from Nippon Aerosil Co., Ltd.) in an air mixer (Henschel mixer; available from Mitsui Mining Co., Ltd.) at a blade speed of 15 m/sec for 2 minutes, so as to obtain negatively chargeable toner T1.

Two-Component Developer

The two-component developers of Examples and Comparative Examples were prepared by mixing carriers C1 to C12 respectively with toner T1. Mixture of the two components were conducted by mixing 6 parts by weight of the toner and 94 parts by weight of the carrier in a Nauta mixer (VL 0; available from Hosokawa Micron Corporation, Japan) for 20 minutes.

Image Evaluation

For the two-component developers prepared, print tests were conducted on an image-forming apparatus as shown in FIG. 2. In the print tests, only the image-forming unit 1 of the four units of the image-forming apparatus was used. The developing conditions used in the image-forming apparatus were: photoconductor drum's peripheral speed of 200 mm/sec; developing roller's peripheral speed of 280 mm/sec; the gap distance between the photoconductor drum and the developing roller of 0.4 mm; the gap distance between the developing roller and the metering blade of 0.5 mm; a temperature of 20° C.; and a humidity of 65%. As the second light-exposure device for developer, a halogen lump was used. The developer was exposed with light at the time of being formed into a magnetic brush. For the test, A4-sized electrophotographic papers (Multi-Receiver; available from Sharp Document Systems Corporation, Japan) were used.

The toner charge, image density and fogging density were measured at the initial printing time (of the first sheet). The methods for the measurements are described.

Toner Charge

The electric charge of the toner was measured on a portable charge measurement device (TREK Model 210HS-2A; available from TREK Japan K.K., Japan)

Image Density

The image density was measured on a reflection densitometer (Macbeth RD918; Gretag-Macbeth GmbH, Germany) in the printing area of the paper where a 3-cm square solid image (100% density) was printed. The evaluation of the image density was based on the following criteria: "Good" when the image density is 1.4 or more (the paper fibers in the printed area are completely coated with the toner, and glossy), "Less Good" when the density is 1.3 or more and less than 1.4 (the paper fibers in the printed area are completely coated with the toner, but less glossy), and "No Good" when the density is less than 1.3 (white paper fibers can be found in the printed area).

Fogging Density

For the fogging density, the image density in a blank area (0% density) was calculated according to the following manner.

The degree of whiteness was measured in a paper before printing and in an imprinted area of the paper after printing on a whiteness meter (Z-Σ90 COLOR MEASURING SYSTEM; available from Nippon Denshoku Industries Co., Ltd., Japan). The difference in the degree of whiteness was considered as the fogging density.

The evaluation of the fogging density was based on the following criteria: "Good" when the fogging density is less than 0.5 (no toner fog can be found macroscopically in the imprinted area), "Less Good" when the density is 0.5 or more and less than 0.8 (a few toner fog can be found macroscopically), and "No Good" when the density is 0.8 or more (toner fog can be found macroscopically).

Results

The results of the print tests are given in Table 2.

TABLE 2

| | Carrier | Charge (μc/g) | Image Density | Fogging |
|---|---|---|---|---|
| Example 1 | C1 | 20.3 | Good (1.43) | Good (0.2) |
| Example 2 | C2 | 20.6 | Good (1.42) | Good (0.3) |
| Example 3 | C3 | 20.9 | Good (1.45) | Good (0.2) |
| Example 4 | C4 | 21.2 | Good (1.43) | Good (0.2) |
| Example 5 | C5 | 20.5 | Good (1.41) | Good (0.3) |
| Example 6 | C6 | 21.6 | Good (1.44) | Good (0.2) |
| Example 7 | C7 | 21.0 | Good (1.45) | Good (0.2) |
| Example 8 | C8 | 20.2 | Good (1.46) | Good (0.3) |
| Comparative Example 1 | C9 | 20.3 | Bad (1.25) | Good (0.2) |
| Comparative Example 2 | C10 | 20.7 | Bad (1.29) | Good (0.3) |
| Comparative Example 3 | C11 | 20.3 | Not Good (1.35) | Bad (1.0) |
| Comparative Example 4 | C12 | 20.5 | Bad (1.21) | Bad (0.8) |

In the print tests using the developers of Examples 1-8, which contain the coated carriers C1-C8 of the invention respectively, images with high image density and low fogging density were obtained.

By contrast, in the print tests using the developers of Comparative Examples 1-4, which contain the coated carriers C9-C12 respectively, images with low image density and/or high fogging density were obtained.

What is claimed is:

1. An electrophotographic carrier comprising a magnetic core particle, a first resin layer containing a charge-generating material coating said core particle, and a second resin layer containing a hole-transporting material coating said first resin layer.

2. The carrier of claim 1, wherein said charge-generating material is a phthalocyanine compound.

3. The carrier of claim 1, wherein said hole-transporting material is a triphenylamine derivative selected from the group consisting of:

(1)

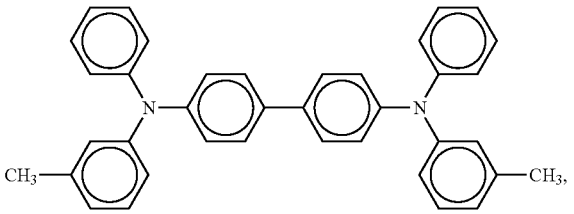

(2)

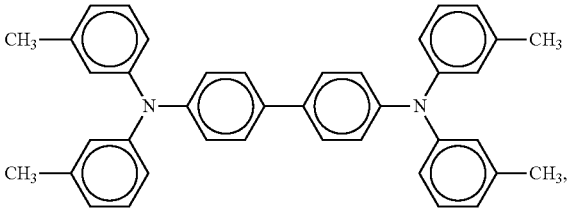

-continued (3)

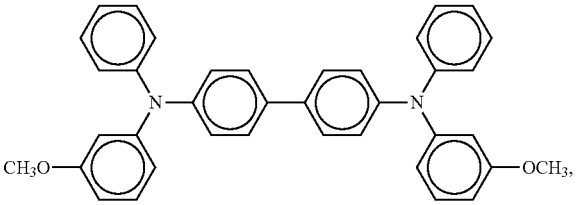

(4)

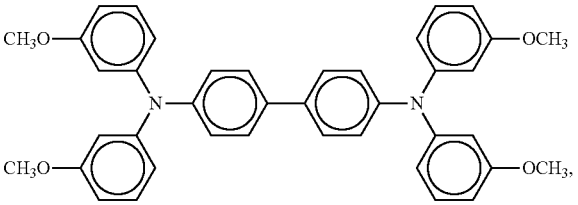

(5)

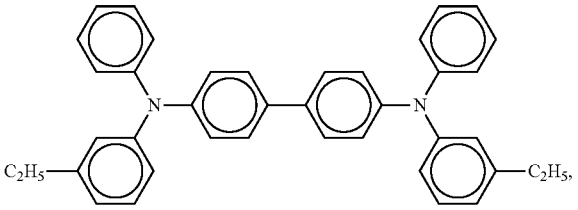

-continued and (6)

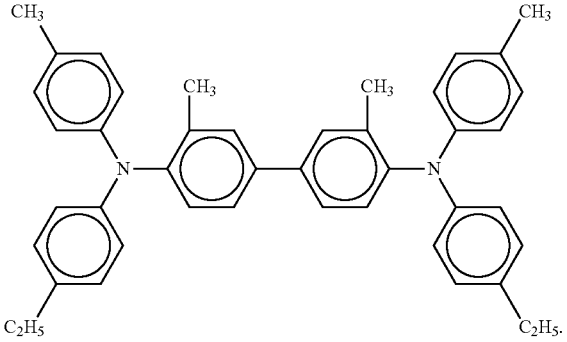

4. The carrier of claim 1, wherein a thermoset silicone resin is used in said first and second resin layers.

5. The carrier of claim 1, wherein said first resin layer is applied and hardened, and subsequently said second resin layer is applied and hardened.

6. A two-component electrophotographic developer comprising the carrier of claim 1 and negatively chargeable toner.

* * * * *